US007327316B2

(12) United States Patent
Geoca et al.

(10) Patent No.: US 7,327,316 B2
(45) Date of Patent: Feb. 5, 2008

(54) EMBEDDED PLANAR INVERTED F ANTENNA (PIFA) TUNED WITH VARIABLE GROUNDING POINT

(75) Inventors: Eric Peter Geoca, Penfield, NY (US); Thomas R. Schleef, Palm Bay, FL (US)

(73) Assignee: Tyco Electronics Corporation, Middletown, PA (US)

( * ) Notice: Subject to any disclaimer, the term of this patent is extended or adjusted under 35 U.S.C. 154(b) by 197 days.

(21) Appl. No.: 11/229,879

(22) Filed: Sep. 19, 2005

(65) Prior Publication Data

US 2007/0063899 A1 Mar. 22, 2007

(51) Int. Cl.
*H01Q 1/38* (2006.01)

(52) U.S. Cl. ..... 343/700 MS; 343/846

(58) Field of Classification Search ..... 343/700 MS, 343/702, 829, 846
See application file for complete search history.

(56) References Cited

U.S. PATENT DOCUMENTS

| | | | | |
|---|---|---|---|---|
| 6,650,295 | B2 | 11/2003 | Ollikainen et al. | |
| 6,662,028 | B1 * | 12/2003 | Hayes et al. | 455/575.7 |
| 6,693,594 | B2 | 2/2004 | Pankinaho et al. | |
| 6,836,249 | B2 * | 12/2004 | Kenoun et al. | 343/700 MS |
| 6,861,986 | B2 | 3/2005 | Fang et al. | 343/700 MS |
| 7,012,570 | B2 * | 3/2006 | Chen et al. | 343/700 MS |

* cited by examiner

*Primary Examiner*—Tho Phan

(57) ABSTRACT

An antenna system is described that includes a radiating element, a feed point configured for electrical connection to the radiating element, and a grounding point configured for electrical connection to the radiating element. At least one of the feed point and the grounding point are configured to accommodate a range of distances between the electrical connections to the radiating element.

5 Claims, 4 Drawing Sheets

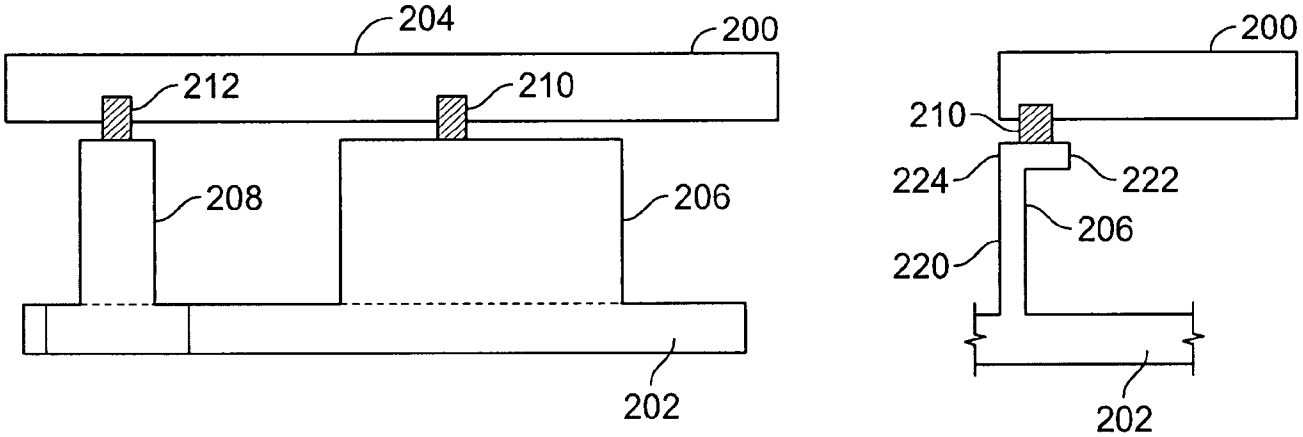
FIG. 7
FIG. 8
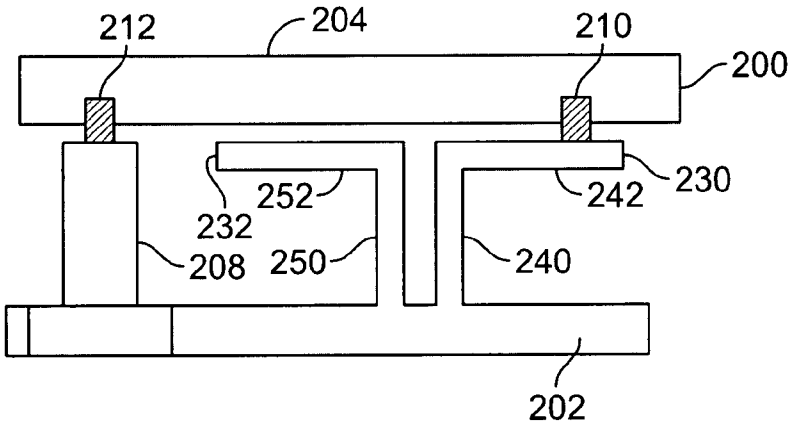
FIG. 9

EMBEDDED PLANAR INVERTED F ANTENNA (PIFA) TUNED WITH VARIABLE GROUNDING POINT

BACKGROUND OF THE INVENTION

This invention relates generally to antenna structures, and more specifically to a planar inverted F antenna (PIFA) that is capable of being tuned via a variable grounding point.

A PIFA type antenna is utilized in many cellular telephones. However, the number, and configurations, of cellular telephones have increased significantly over the last several years. Currently, embedded PIFA design antennas are custom tuned for each specific cellular telephone style or platform. As such, a new and custom PIFA design is created, and then fabricated, for each new telephone type. Each antenna design typically contemplates a fixed grounding point and a fixed antenna feed point within the telephone.

A PIFA with more than one grounding connection is known. However, operation of this PIFA contemplates the switching of various impedances between the radiating element and the grounding plane. Addition of impedances and switches tend to act as transmission lines at the frequencies of operation. In addition, the number of switches and impedances in these antennas are limited as each adds one or more of size and cost to the product incorporating the antenna. As such, a truly variable grounding point antenna, which does not necessitate utilization of switches and impedances is needed.

BRIEF DESCRIPTION OF THE INVENTION

In an exemplary embodiment an antenna system is provided. The antenna system comprises a radiating element, a feed point configured for electrical connection to the radiating element, and a grounding point configured for electrical connection to the radiating element. At least one of the feed point and the grounding point are configured to accommodate a range of distances between the electrical connections to the radiating element.

In another exemplary embodiment, a method for connecting an antenna to a circuit is provided. The method comprises providing an antenna radiating element, and configuring a feed point and a ground point for electrical connection to the radiating element. At least one of the feed point and the grounding point are configured to accommodate a range of distances between the electrical connections to the radiating element.

In another exemplary embodiment, an antenna is provided that comprises a radiating element, a feed point extending from the radiating element, and a grounding point extending from the radiating element. At least one of the feed point and the grounding point are configured to accommodate a range of distances between electrical connections to an external circuit.

BRIEF DESCRIPTION OF THE DRAWINGS

FIG. 7 is a side view illustrating a grounding point and a feed point extending from a circuit board to engage a radiating element of a PIFA.

FIG. 8 is an end view of the configuration illustrated in FIG. 7.

FIG. 9 is a side view illustrating an alternative embodiment for a grounding point extending from a circuit board to engage the radiating element of a PIFA.

DETAILED DESCRIPTION OF THE INVENTION

Figure 1:
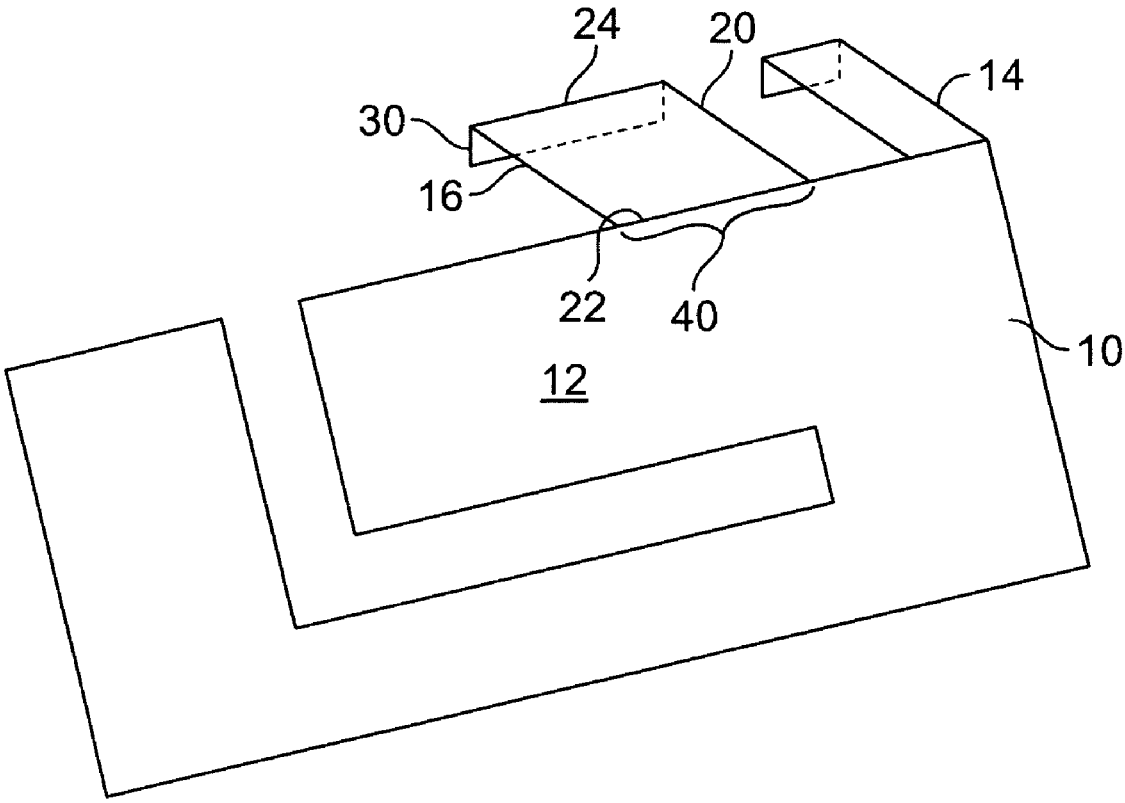
FIG. 1 is a perspective view of a planar inverted F antenna (PIFA) according to an exemplary embodiment of the invention.

FIG. 1 is a perspective view of an antenna 10 formed in accordance with an exemplary embodiment of the present invention. In the embodiment, antenna 10 is configured for use in a mobile (e.g., cellular) telephone. Antenna 10 includes a radiating element 12, a feed point 14 extending from the radiating element 12, and a grounding point 16 extending from the radiating element 12.

As further described below, the feed point 14 is configured to engage an antenna feed contact of a transmitter, for example, a mobile (e.g., cellular) telephone. The grounding point 16 is configured to engage a ground contact and further is configured to provide for a range of offsets or distances between where the antenna feed contact engages the feed point 14 and where the ground contact engages the grounding point 16. The grounding point 16 includes a first member 20 that includes a first end 22 and a second end 24, and the first member 20 extends substantially perpendicularly from the radiating element 12 at the first end 22. A second member 30 of grounding point 16 extends substantially perpendicularly from the second end 24 of the first member 20. As will be described, the second member 30 is configured to engage a ground contact of a transmitter, for example, a mobile (e.g., cellular) telephone.

To provide for a range of offsets between the antenna feed contact and the ground contact, grounding point 16 is configured with a width 40 as illustrated in FIG. 1. Through utilization of the width 40 of grounding point 16, antenna 10 may be utilized in a plurality of applications. For example, and as stated above, the known practice is to design and fabricate individual antennas with a uniquely placed feed point and grounding point for each new cellular telephone design.

Figure 2:
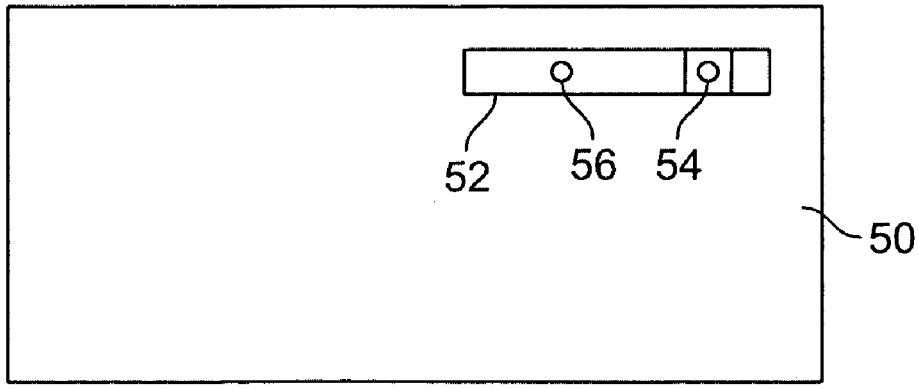
FIG. 2 is a view of a cellular telephone chassis including an antenna engagement block.

FIG. 2 is a top view of an antenna interface 50 for a cellular telephone. The antenna interface 50 includes an antenna engagement block 52 which further includes an antenna feed contact 54 and a grounding contact 56 extending from a transceiver (not shown) within the telephone. For various telephone designs, the antenna feed contact 54 and the grounding contact 56 may be nearer to one another or farther from one another. The separation between the antenna feed contact 54 and the grounding contact 56 is dependent upon several factors, including, but not limited to, the frequency range for the transceiver and the desired physical dimensions for the cellular telephone.

Figure 3:
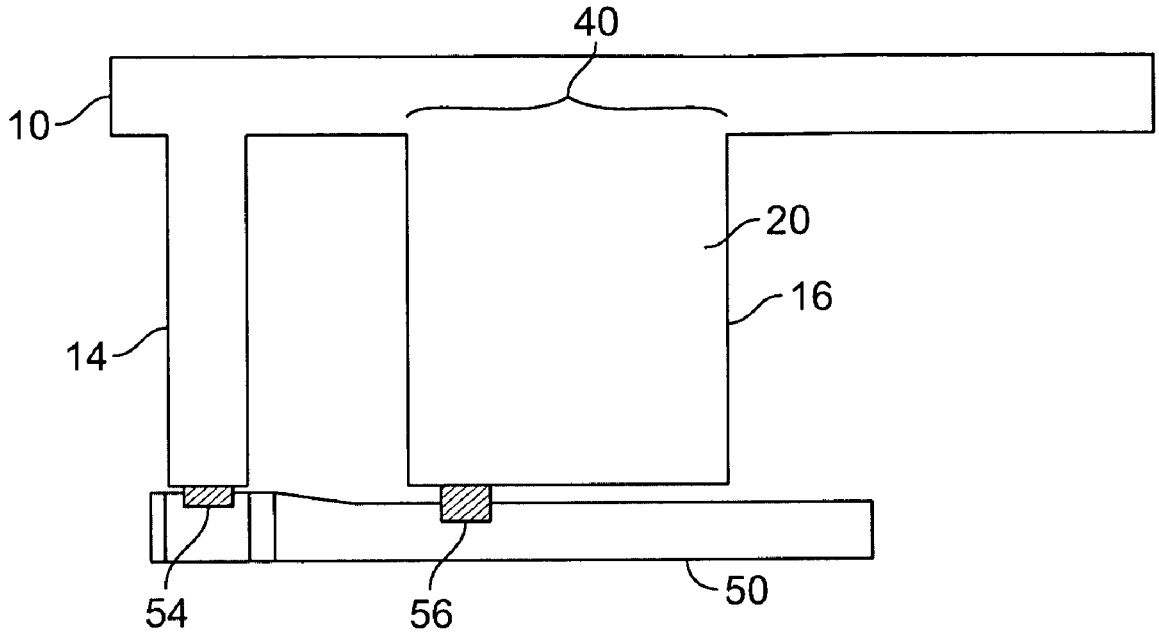
FIG. 3 is side view of the antenna of FIG. 1.

FIG. 3 is a side view of the antenna 10 engaging the antenna interface 50. As illustrated, when the antenna 10 is installed, the antenna feed contact 54 engages the feed point 14. In addition, the grounding contact 56 engages the grounding point 16. As different transmitter frequencies are utilized, for example, it is possible for a designer of transceiver designs (e.g., cellular telephones) to adjust a position of grounding contact 56 with respect to feed contact 54. However, due to the width 40 of grounding point 16, the same antenna 10 may be utilized for the various designs. In the side view of FIG. 3, only the first member 20 of the grounding point 16 is visible.

Figure 4:
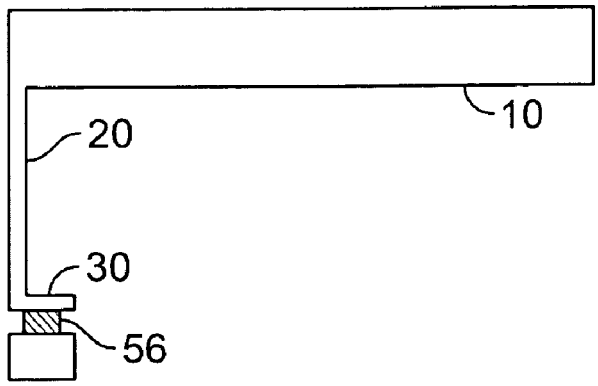
FIG. 4 is an end view of the antenna of FIG. 1.

FIG. 4 is an end view of the antenna 10 engaging the antenna interface 50. In the end view, both the first member 20 and the second member 30 of the grounding point 16 are visible. As illustrated, grounding contact 56 is configured to engage the second member 30 of the grounding point 16.

Figure 5:
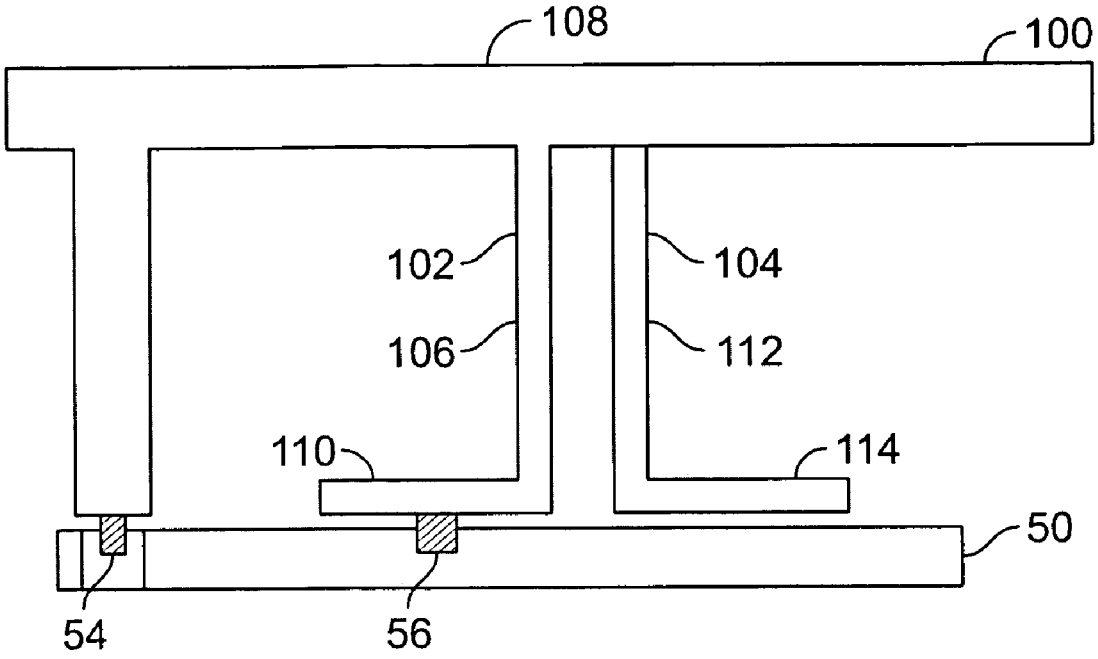
FIG. 5 is a side view of an alternative embodiment for a PIFA having a variable grounding point.

FIG. 5 illustrates a side view of an alternative embodiment of antenna 100 which provides for a range of offsets between the antenna feed contact 54 and the grounding contact 56. Rather than providing a single grounding point with a width (e.g., grounding point 16 with width 40), the grounding point of antenna 100 includes a plurality of separate grounding members 102 and 104 that extend from radiating element 108. The grounding member 102 includes a vertical member 106 which extends between radiating element 108 and grounding element 110. The grounding member 104 also includes a vertical member 112 which extends between radiating element 108 and grounding element 114. As illustrated, grounding elements 110 and 114 extend from their respective vertical members 106 and 112 in an opposite direction. As a result, antenna 100 provides compatibility with a range of offsets between the antenna feed contact 54 and the ground contact 56.

Figure 6:
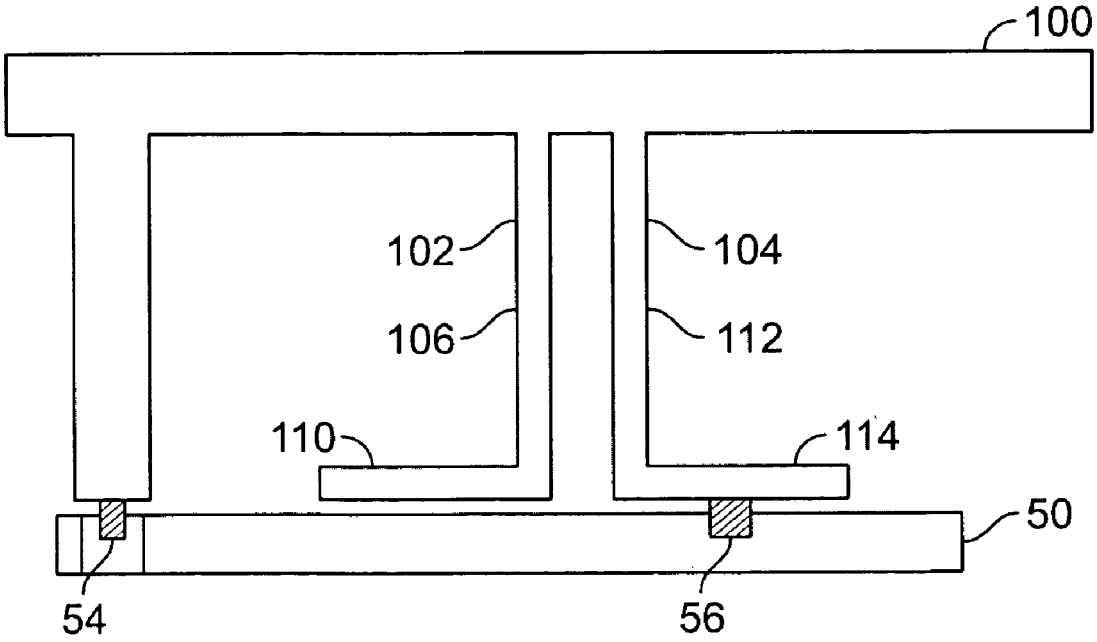
FIG. 6 is an end view of the antenna of FIG. 5.

FIG. 6 is a side view of antenna 100 illustrating an offset between antenna feed contact 54 and grounding contact 56 that is different than the offset illustrated in FIG. 5. As antenna 100 (and antenna 10) are both configured to be operable with a range of offsets between the antenna feed contact 54 and the grounding contact 56, antennas 10 and 100 may be tuned for use in multiple cellular telephone configurations. In addition, altering a position of the point at which the antenna contacts the ground contact of the transceiver provides a capability for antenna tuning, rather than an altering of the slots formed in the radiating element of the antenna. Altering a position of the point at which the antenna contacts the ground contact of the transceiver further provides for a varying of the distance between a feed point and the grounding point of the antenna which changes the operating frequency of the antenna.

PIFAs are not necessarily all fabricated with feed point and grounding points extending therefrom. FIG. 7 illustrates an alternative embodiment for incorporating a variable position grounding point. Specifically, FIG. 7 is a side view illustrating a PIFA 200 and a circuit board 202, for example, from a cellular telephone. The circuit board 202 is configured to accommodate a circuit (not shown) thereon. Rather than extending from a radiating element 204 of PIFA 200, a grounding point 206 and a feed point 208 extend from circuit board 202 to engage the radiating element 204 of the PIFA 200 at grounding contact 210 and antenna feed contact 212 respectively. As can be understood from the illustration of FIG. 7, the grounding contact 210 may be located anywhere along the width of grounding point 206 which results in a variable separation between grounding point 206 and feed point 208. The variable separation results in an antenna that operates over a range of frequencies.

FIG. 8 is an end view of the alternative embodiment illustrated in FIG. 7 and further illustrates the grounding point 206 extending from the circuit board 202. Similar to the embodiments described above, the grounding point 206 includes a vertical member 220 which extends from the circuit board 202 to a grounding element 222 which makes electrical contact with the grounding contact 210. In the embodiment illustrated, the grounding element 222 extends substantially perpendicularly from a top portion 224 of the vertical member 220.

FIG. 9 is a side view illustrating an alternative embodiment in which the grounding point includes multiple grounding members 230, 232 extending from the circuit board 202 to engage the radiating element 204 of the PIFA 200. The embodiment also provides for a range of offsets between the antenna feed contact 212 and the grounding contact 210. Rather than providing a grounding point that extends from a circuit board with a width (e.g., grounding point 206 shown in FIGS. 7 and 8), the embodiment of FIG. 9 incorporates separate grounding members 230 and 232 that extend from circuit board 202. The grounding member 230 includes a vertical member 240 which extends between circuit board 202 and a grounding element 242. The grounding member 232 also includes a vertical member 250 which extends between circuit board 202 and a grounding element 252. As illustrated, grounding elements 242 and 252 extend from their respective vertical members 240 and 250 in an opposite direction. As a result, antenna 200 is provided with a range of offsets between the antenna feed contact 212 and the ground contact 210. As illustrated, the antenna feed contact 212 and the ground contact 210 extend from antenna 200. However, embodiments are contemplated where the antenna feed contact and ground contact extend from the respective antenna feed point and grounding point to engage the PIFA.

While described herein as a fixed feed contact and a movable grounding contact, it should be understood that such descriptions are examples only. PIFAs with a fixed ground contact and a movable feed contact are contemplated as well as PIFAs having both a movable feed contact and a movable ground contact. In addition, embodiments that include multiple feed members or grounding members to provide a wider range of operating frequency flexibility are contemplated.

Similar variations are contemplated for embodiments in which the antenna feed points and grounding points extend from a circuit board or printed wiring board to engage the radiating element of the PIFA. In addition, embodiments where feed points are configured as having a width or multiple feed elements as well as embodiments where one or both of the feed and grounding points include multiple elements are also contemplated.

While the invention has been described in terms of various specific embodiments, those skilled in the art will recognize that the invention can be practiced with modification within the spirit and scope of the claims.

What is claimed is:

1. An antenna system comprising:

a radiating element;

a feed point configured for electrical connection to said radiating element;

a grounding point configured for electrical connection to said radiating element, at least one of said feed point and said grounding point configured to accommodate multiple distances between the electrical connections to said radiating element, wherein said feed point and said grounding point extend from said radiating element;

an antenna feed contact configured to connect a circuit to said feed point; and a grounding contact configured to connect the circuit to said ground point, at least one of said feed point and said grounding point configured such that a distance between said antenna feed contact and said grounding contact is variable.

2. An antenna system comprising:

a radiating element;

a feed point confirmed for electrical connection to said radiating element;

a grounding point configured for electrical connection to said radiating element, at least one of said feed point and said grounding point configured to accommodate multiple distances between the electrical connections to said radiating element, wherein each of said feed point and said grounding point are configured to extend from a circuit;

an antenna feed contact connecting said radiating element and said feed point; and a grounding contact connecting said radiating element and said grounding point, at least one of said feed point and said grounding point configured with a width such that a distance between said antenna feed contact and said grounding contact is variable.

3. An antenna comprising:

a radiating element;

at least one feed point extending from said radiating element; and at least one grounding point extending from said radiating element, at least one of said feed point and said grounding point configured to accommodate a range of distances between electrical connections to an external circuit;

wherein at least one of said feed point and said grounding point is configured with a width, the width accommodating the range of offsets between the electrical connections to the external circuit.

4. An antenna comprising:

a radiating element;

at least one feed point extending from said radiating element; and at least one grounding point extending from said radiating element, at least one of said feed point and said grounding point configured to accommodate a range of distances between electrical connections to an external circuit;

wherein at least one of said grounding point and said feed point comprises:

a first member comprising a first end and a second end, said first member extending substantially perpendicularly from said radiating element at said first end; and a second member extending substantially perpendicularly from said second end of said first member.

5. An antenna comprising:

a radiating element;

at least one feed point extending from said radiating element; and at least one grounding point extending from said radiating element, at least one of said feed point and said grounding point configured to accommodate a range of distances between electrical connections to an external circuit;

wherein at least one of said grounding point and said feed point comprises:

a plurality of members extending substantially perpendicularly from said radiating element; and an element extending substantially perpendicularly from each of said members, each said element extending in a direction so as to not interfere with the other said elements.

* * * * *